US008419515B1

(12) United States Patent
Dillon

(10) Patent No.: US 8,419,515 B1
(45) Date of Patent: Apr. 16, 2013

(54) MAGNETIC REGISTER VENT COVER AND ASSOCIATED METHOD

(76) Inventor: Kevin Dillon, Millersville, MD (US)

( * ) Notice: Subject to any disclaimer, the term of this patent is extended or adjusted under 35 U.S.C. 154(b) by 1105 days.

(21) Appl. No.: 12/319,395

(22) Filed: Jan. 7, 2009

Related U.S. Application Data

(60) Provisional application No. 61/011,222, filed on Jan. 17, 2008.

(51) Int. Cl.
*F24F 7/00* (2006.01)

(52) U.S. Cl.
USPC ..... 454/284; 454/331

(58) Field of Classification Search ..... 454/284, 454/286, 289, 290, 291, 152, 153, 154, 155, 454/333, 906, 330, 331, 332
See application file for complete search history.

(56) References Cited

U.S. PATENT DOCUMENTS 3,203,338 A * 8/1965 Dry ..... 454/318
3,504,618 A * 4/1970 Rosner ..... 454/332
4,398,371 A 8/1983 Jenkins
5,479,984 A 1/1996 Easterbrook
D393,708 S 4/1998 Assai

FOREIGN PATENT DOCUMENTS

JP 57148132 A * 9/1982
JP 2001219736 A * 8/2001

* cited by examiner

*Primary Examiner* — Steven B McAllister
*Assistant Examiner* — Brittany E Towns

(57) ABSTRACT

An air register for diffusing air away from an existing air duct may include a body with an open panel and plurality of louvers situated therealong. The body may include a plurality of planar side walls extending orthogonally to the panel and disposed inwardly from an outer perimeter thereof. A mechanism may be included for articulating the interconnected louvers between open and closed positions. A second mechanism may be included for magnetically affixing the planar walls to the existing air duct. In operation, the magnetically affixing mechanism may be automatically displaced outwardly and away from the planar side walls while the interconnected louvers biasing mechanism is toggled between the open and closed positions. In this manner, the body may be maintained at a substantially stable position during articulation of the interconnected louvers by maintaining the magnets firmly against the walls of the air duct.

16 Claims, 4 Drawing Sheets

MAGNETIC REGISTER VENT COVER AND ASSOCIATED METHOD

CROSS REFERENCE TO RELATED APPLICATIONS

This application claims the benefit of U.S. Provisional Application No. 61/011,222, filed Jan. 17, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to air duct registers and, more particularly, to a magnetically affixed air duct register for diffusing air away from an existing air duct.

2. Prior Art

Forced air heating and cooling systems provide an economical and quick reaction to desired temperature changes in a structure. Forced air systems are used in winter for heating by blowing air around a fire box, which may be fueled by gas, oil or coal, or around an electrical or fluid heat source, and then blowing the air through a register and through sealed ducts along floors and wall, and then finally releasing the air through registers, which are wall, floor or ceiling mounted. The air is drawn into the system through large intakes, is collected through intake ducts, and is again blown around the heat source or sealed fire box to heat the air. In summer, often the same forced air system is used. A heat exchanger is imposed across the major duct, and a refrigeration system outside of the structure draws fluid from the heat exchanger, compresses the fluid, cools the compressed fluid and returns the fluid to the heat exchanger for expansion and cooling the heat exchanger. The forced air is circulated over, around and through the heat exchanger, is cooled, and is circulated through the ducts and branch ducts, out of the registers and through the structure before it is returned to the heat exchanger.

When designing structures and forced air systems for the structures, much attention is given to the size and straightness of the main duct and to the size of the branch ducts, and to positioning of registers within rooms. The positioning of registers in rooms is made more difficult by dual-purpose heating and air conditioning systems. Registers for heating are best positioned near a floor, and registers for cooling are best positioned near a ceiling. Heated air tends to flow upward and cool air tends to flow downward. Standard registers measure about 3 inches by 10 inches, or 4 inches by 10 inches, according to the size of the room and available space for installation.

Such registers are conventionally mounted to a support surface, whether ceiling, wall or floor, by threaded fasteners. Such threaded fasteners, even when countersunk, greatly detract from the smooth planar design of the register vent's outer surface. Furthermore, user of threaded fasteners weakens the structural integrity where they are inserted into the support surface. As such, there is an increased risk for mechanical failure in the areas around a register vent.

U.S. Pat. No. 5,505,379 to Wagner discloses a movable-louver heating and cooling register. The heating and cooling register has movable louvers installed on pivots that are formed in the register body. Two control arms are used to pivot the groups of louvers. The control arms are mounted on diagonals from each other. Both control arms are attached to a central control shaft, which is designed to rotate about its central axis. Because the control arms are mounted on opposite sides on the diagonal, as the control shaft is rotated, it pulls the two control arms in opposite directions. This causes each set of louvers to move in opposite directions. The advantage of movable louvers is that they can be used with both heating and cooling cycles. To operate the louvers, the control shaft can be turned by hand. Unfortunately, this prior art reference does not disclose a means of securing the register by way of magnetically affixing it to the existing air duct in order to permit a smooth outer surface of the register, free of raised fasteners.

U.S. Pat. No. 4,398,371 to Jenkins discloses a magnetic smoke and fire shield for installation adjacent an air register associated with a building conduit to control the conduit opening. The apparatus includes a frame containing an opening, and a closure member connected with the frame for movement between open and closed positions relative to the frame opening. At least one of the closure members and frame is formed of ferromagnetic material, the other member having magnetic sealing means associated therewith. The closure member is retained in the open position by means including a fusible link set to melt at a predetermined temperature. The closure member may also be released manually. Upon the occurrence of a fire, the closure member is released to a closed, magnetically sealed position relative to the frame opening. Unfortunately, this prior art reference does not disclose a means for permitting and adjusting the flow of air through building conduits for purposes of adjusting room temperatures, and would not be easily adapted to be employed for such purposes.

U.S. Pat. No. 5,479,984 to Easterbrook discloses a heavy flexible magnetic panel for sealing a register of a forced air system. The magnetic panel is placed over the register and adheres to the entire panel and over the entire register for preventing escape of forced air from the register. The flexible magnetic panel is used on wall registers, on floor registers and on ceiling registers. Unfortunately, this magnetic panel is employed to stop air flow and is not designed for holding the register in place while a user adjusts the amount of air permitted to flow out thereof.

Accordingly, a need remains for an air register in order to overcome the above-noted shortcomings. The present invention satisfies such a need by providing an apparatus that is convenient and easy to use, is durable yet lightweight in design, is versatile in its applications, and provides a method for diffusing air away from an existing air duct.

BRIEF SUMMARY OF THE INVENTION

In view of the foregoing background, it is therefore an object of the present invention to provide an apparatus for diffusing air away from an existing air duct. These and other objects, features, and advantages of the invention are provided by an air diffusing register.

An air register for diffusing air away from an existing air duct may include a body preferably having an open panel provided with a plurality of interconnected louvers situated therealong. The body further may have a plurality of planar side walls extended orthogonally to the panel and disposed inwardly from an outer perimeter of the panel respectively.

The placement of the side walls in relation to the panel may allow the apparatus to be firmly set in an existing hole in a floor, wall, or ceiling such that the side walls may remain adjacent to the perimeter of the existing hole while the panel may be positioned parallel and flat against the surface in which the hole is cut. Additionally, a mechanism may be included for articulating the interconnected louvers between open and closed positions. Such a mechanism may allow the user to adjust the hot or cold air flow out of the air duct to adjust room temperatures accordingly.

The interconnected louvers biasing mechanism may further include a lever situated exterior of the panel which may be reciprocated along a first linear travel path defined orthogonal to a longitudinal length of the body. Such a lever may be produced to slide subjacent to the panel surface and within a groove formed thereon to further maintain a smooth planar outer surface of the register to prevent unwanted snares of a user's clothing. Further, a drum may be included and directly coupled to the lever. The drum may include an oscillating channel formed along an outer surface thereof. In this manner, the lever may cause the drum to rotate along clockwise and counter clockwise directions as the lever is linearly reciprocated along the first linear travel path. As the lever is pushed by the user along the surface groove, it may travel along the oscillating channel of the drum, rotating the drum to operate the mechanism.

The biasing mechanism may additionally include a plurality of drive wheels mated to the drum such that the drive wheels may be coaxially and synchronously rotated with the drum about a first fulcrum axis. Also, a rectilinear driven rod may be included and rotatably conjoined to the drive wheels respectively. Such a driven rod may be anchored to the interconnected louvers and may be caused to rotate in sync with the drive wheels to thereby articulate the interconnected louvers between the open and closed positions as the lever is linearly reciprocated along the first linear travel path. This may permit the user to open and close the louvers simultaneously with one simply adjustment of the lever.

The air register may additionally include a mechanism for magnetically affixing the planar walls to the existing air duct. Such a mechanism is vital and advantageous in eliminating the need for fasteners such as screws, bolts, or nails to be employed in securing the register to the surface of the wall or floor. On a floor vent in particular, this may prevent the uncomfortable feel of fasteners with raised metal heads that may catch a user's foot, damaging clothing or causing injury. The magnetic affixing mechanism may allow the register to maintain a smooth, unblemished surface that not only prevents unwanted scrapes or tears, but also maintains an aesthetic appearance.

In operation, the magnetically affixing mechanism may be automatically displaced outwardly and away from the planar side walls while the interconnected louvers biasing mechanism is toggled between the open and closed positions. In this manner, the body may be maintained at a substantially stable position during articulation of the interconnected louvers. This is advantageous in that it may ensure the register does not slide or become undesirably repositioned when a user applies force to the lever to open the louvers. The affixing mechanism may apply outward pressure upon the side walls to make certain that a magnetic connection is maintained with the metallic air duct.

The magnetically affixing mechanism may further include a plurality of rectilinear arms statically affixed to the drive wheels and preferably pivotal about the first fulcrum axis as the drum rotates. Also, the mechanism may include a plurality of driven wheels rotatably engaged with the rectilinear arms respectively. In this manner, the driven wheels may be rotated about a second fulcrum axis registered parallel to the first fulcrum axis when the user reciprocates the lever, turning the drum and respective drive wheels, and persuading the arms to turn the driven wheels in sync therewith. Additionally, a plurality of magnetic members may be dynamically coupled to selected ones of the planar side walls, which is vital and advantageous in securing the register to the inner walls of the air duct. Each of the magnetic members may have a medial end seated inside the body and continuously mated to the driven wheels. In addition, the magnetic members may have rectilinear longitudinal lengths extending along a major longitudinal length of the planar side of the register to ensure a stable and secure magnetic connection between the majority of the side wall and the air duct.

Each of the driven wheels may additionally have a groove formed therein, with the grooves preferably having a varying depth defined along a longitudinal length thereof. In operation, the magnetic members may be linearly reciprocated along respective second linear travel paths defined by the varying depth of the grooves as the driven wheels are rotated along clockwise and counter clockwise directions. As the driven wheels rotate, the medial ends of the magnetic members may rise and fall with the depth of the grooves, creating an outward force against the magnetic members and side walls and assisting in maintaining the magnetic connection with the air duct as the user applies force to the lever.

In addition, the apparatus may include the first and second linear travel paths being oriented parallel to each other. Thus, while the user applies force to the lever, the magnetic members may be simultaneously forced in an identical and opposite linear direction concurrently by the affixing mechanism, which is vital in ensuring the register remains securely connected to the air duct. Further, a reciprocating linear displacement of the lever may cause a reciprocating pivoting displacement of the louvers as well as a reciprocating linear displacement of the magnetic members respectively. Additionally, the magnetic members may be simultaneously urged outwardly and away from the planar side walls when the lever is linearly reciprocated along the first linear travel path. The combination of these elements provides the unpredictable and unexpected result of allowing the user to adjust the air flow through the levers while ensuring the register remains statically situated, even without the use of traditional screw or bolt fasteners.

The present invention may further include a method for removably affixing an air register to an existing air duct. Such a method may include the chronological steps of first providing a body preferably having an open panel provided with a plurality of interconnected louvers situated therealong. The body further may include a plurality of planar side walls extending orthogonally to the panel and disposed inwardly from an outer perimeter of the panel respectively. The body may be produced in a variety of sizes to best fit within standard sized openings of common ductwork designs. A second step of the method may include providing a mechanism for articulating the interconnected louvers between open and closed positions. Third, the method may entail providing a mechanism for magnetically affixing the planar walls to the existing air duct. Finally, a fourth step of the method may include automatically displacing the magnetically affixing mechanism outwardly and away from the planar side walls while toggling the interconnected louvers biasing mechanism between the open and closed positions. In this manner, the body may be maintained at a substantially stable position during articulation of the interconnected louvers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
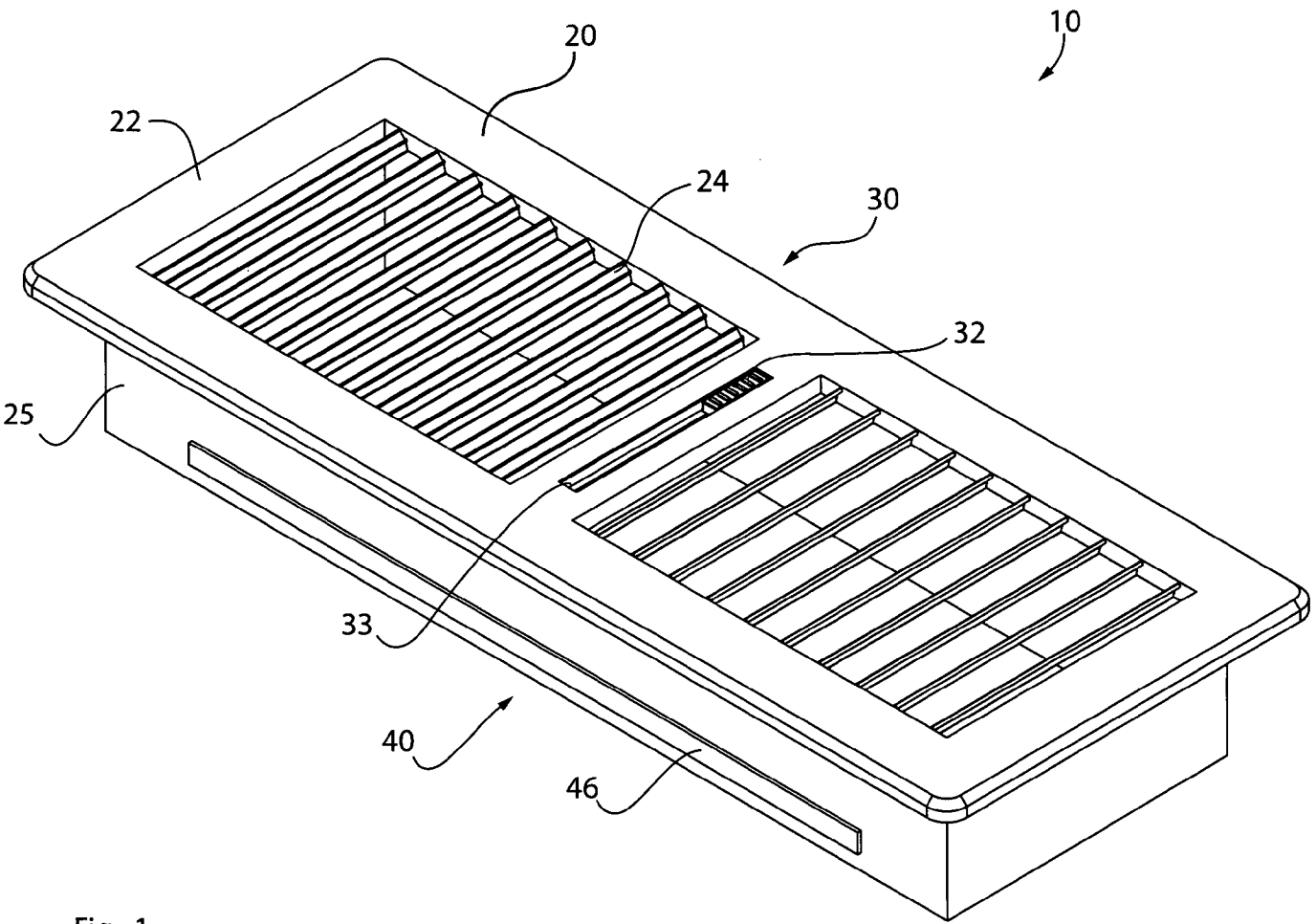
FIG. 1 is a perspective view showing an air register for diffusing air away from an existing duct, in accordance with the present invention.
Figure 2:
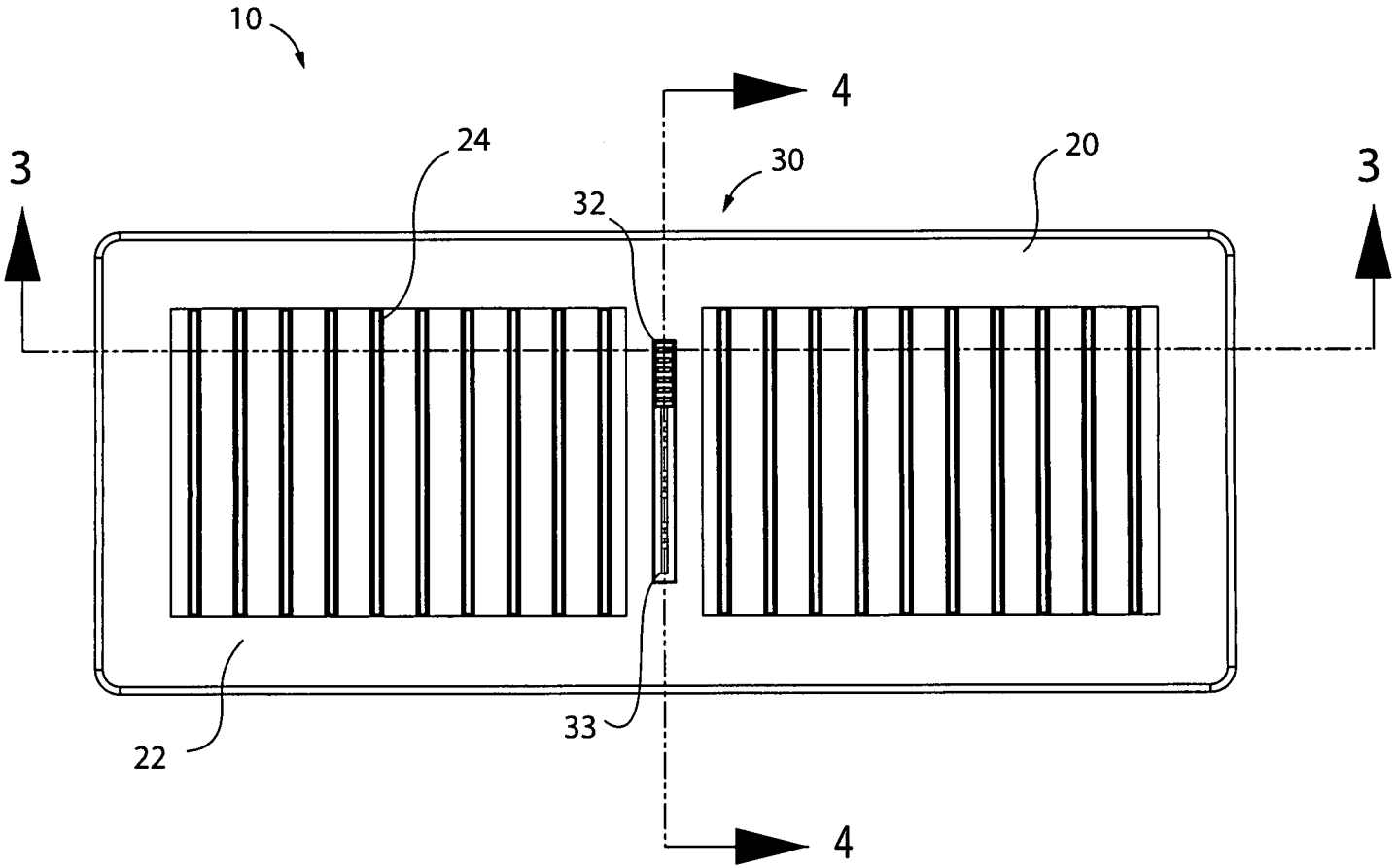
FIG. 2 is a top plan view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide an air register. It should be understood that the air register 10 may be used to cover and adjust the air flow out of many different types, sizes, and shapes of ductwork openings, and may be designed to be used in both residential and commercial settings.

Referring to FIGS. 1-4 initially, an air register 10 for diffusing air away from an existing air duct may include a body 20 preferably having an open panel 22 provided with a plurality of interconnected louvers 24 situated therealong. The body 20 further may have a plurality of planar side walls 25 extended orthogonally to the panel 22 and disposed inwardly from an outer perimeter of the panel 22 respectively. The placement of the side walls 25 in relation to the panel 22 may allow the apparatus 10 to be firmly set in an existing hole in a floor, wall, or ceiling such that the side walls 25 may remain adjacent to the perimeter of the existing hole while the panel 22 may be positioned parallel and flat against the surface in which the hole is cut. Additionally, a mechanism 30 may be included for articulating the interconnected louvers 24 between open and closed positions. Such a mechanism 30 may allow the user to adjust the hot or cold air flow out of the air duct to adjust room temperatures accordingly.

Referring again to FIGS. 1-4, the interconnected louvers biasing mechanism 30 may further include a lever 32 situated exterior of the panel 22 which may be reciprocated along a first linear travel path defined orthogonal to a longitudinal length of the body 20. Such a lever 32 may be produced to slide subjacent to the panel surface 23 and within a groove 33 formed thereon to further maintain a smooth planar outer surface 23 of the register 10 to prevent unwanted snares of a user's clothing. Further, a drum 34 may be included and directly coupled to the lever 32. The drum 34 may include an oscillating channel 35 formed along an outer surface thereof. In this manner, the lever 32 may cause the drum 34 to rotate along clockwise and counter clockwise directions as the lever 32 is linearly reciprocated along the first linear travel path. As the lever 32 is pushed by the user along the surface groove 33, it may travel along the oscillating channel 35 of the drum 34, rotating the drum 34 to operate the mechanism 30.

Figure 3:
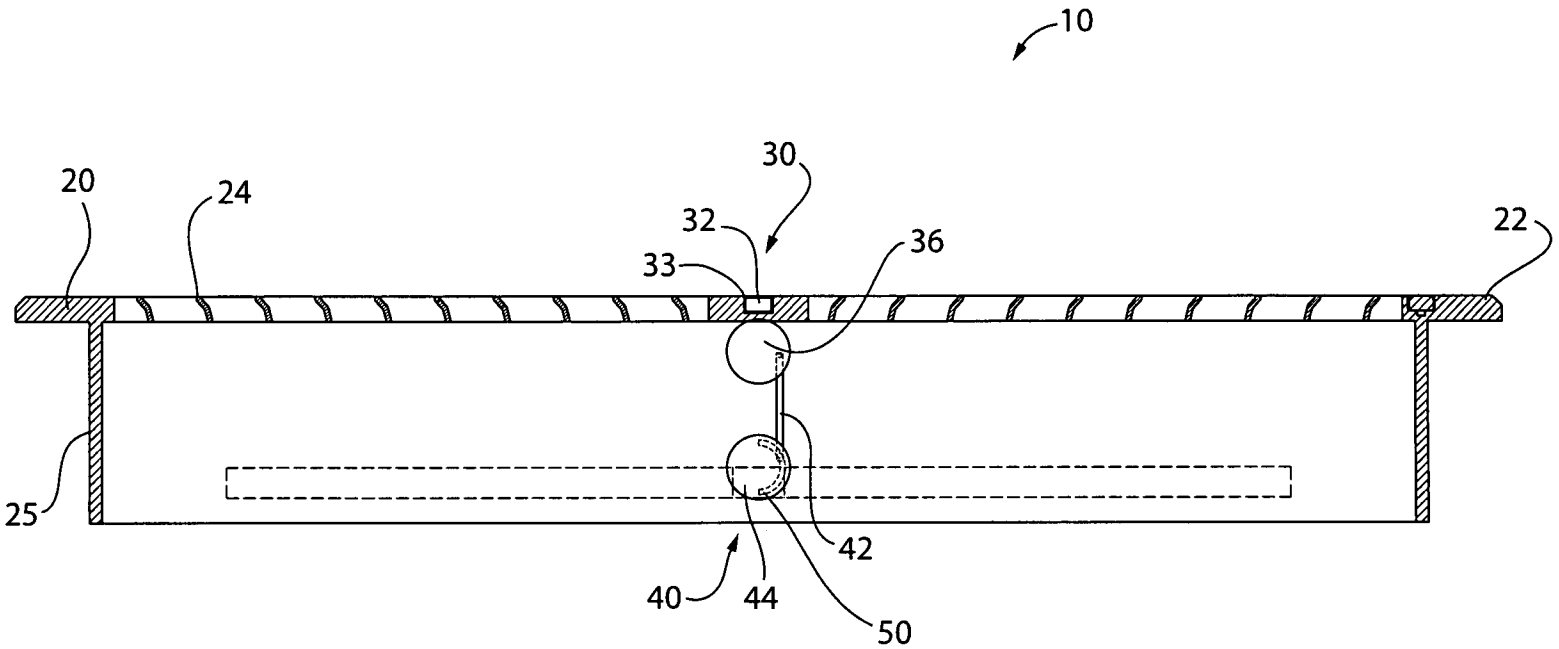
FIG. 3 is a cross-sectional view of the apparatus shown in FIG. 2, taken along line 3-3, further showing the internal components of the magnetically affixing mechanism.
Figure 4:
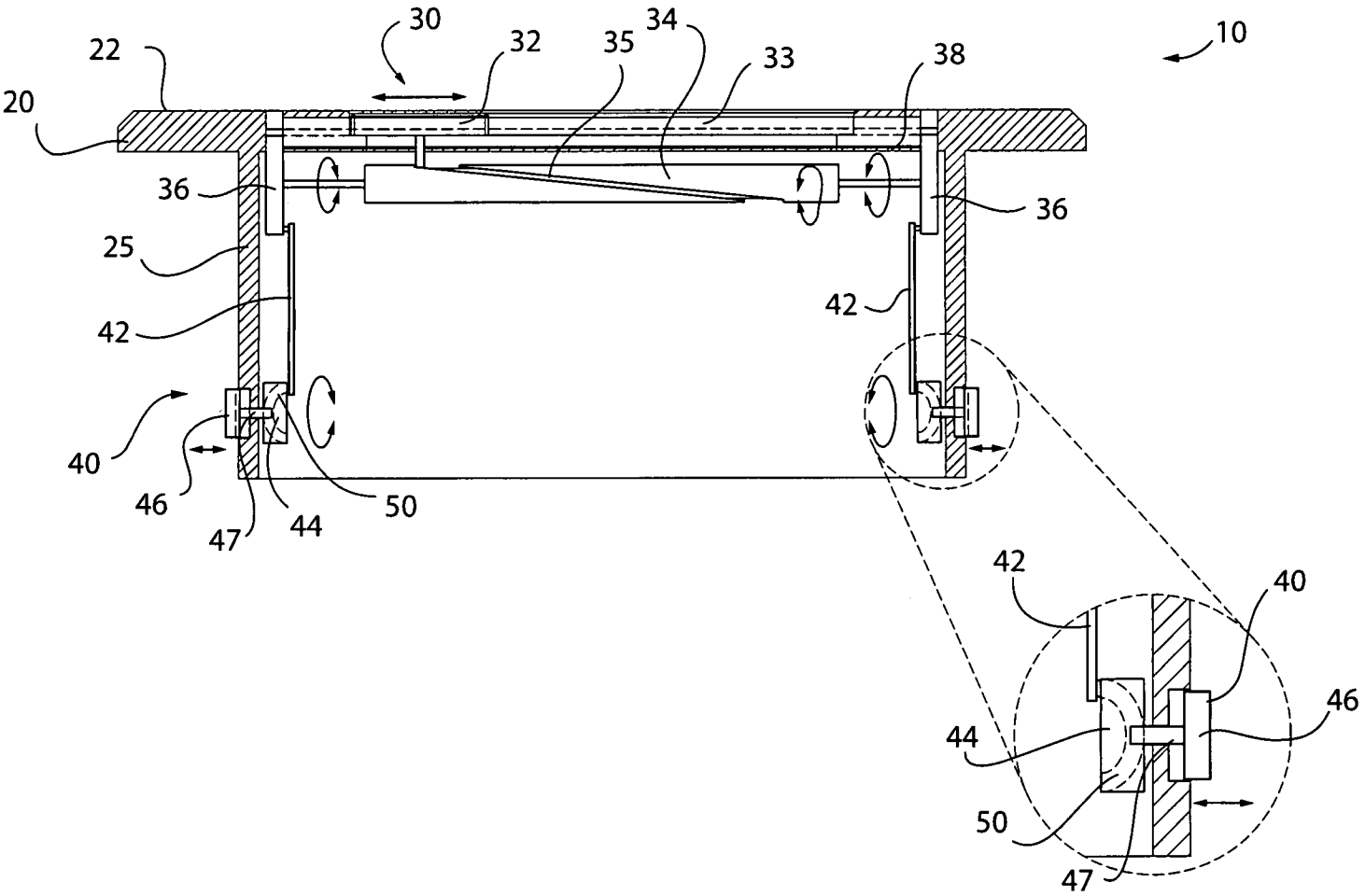
FIG. 4 is a cross-sectional view of the apparatus shown in FIG. 2, taken along line 4-4, displaying the interconnected louver biasing mechanism in conjunction with the magnetically affixing mechanism (shown in the enlarged call out view).

Referring now to FIGS. 3 and 4, the biasing mechanism 30 may additionally include a plurality of drive wheels 36 mated to the drum 34 such that the drive wheels 36 may be coaxially and synchronously rotated with the drum 34 about a first fulcrum axis. Also, a rectilinear driven rod 38 may be included and rotatably conjoined to the drive wheels respectively. Such a driven rod 38 may be anchored to the interconnected louvers 24 and may be caused to rotate in sync with the drive wheels 36 to thereby articulate the interconnected louvers 24 between the open and closed positions as the lever 32 is linearly reciprocated along the first linear travel path. This may permit the user to open and close the louvers 24 simultaneously with one simply adjustment of the lever 32.

Now referring to FIGS. 1, 3, and 4, the air register 10 may additionally include a mechanism 40 for magnetically affixing the planar walls 25 to the existing air duct. Such a mechanism 40, as claimed, provides the unexpected and unpredictable benefit of eliminating the need for fasteners such as screws, bolts, or nails to be employed in securing the register 10 to the surface of the wall or floor. On a floor vent in particular, this is vital and advantageous in that it may prevent the uncomfortable feel of fasteners with raised metal heads that may catch a user's foot, damaging clothing or causing injury. The magnetic affixing mechanism 40 may allow the register 10 to maintain a smooth, unblemished surface 23 that not only prevents unwanted scrapes or tears, but also maintains an aesthetic appearance, a benefit not rendered obvious by one skilled in the art.

In operation, the magnetically affixing mechanism may be automatically displaced outwardly and away from the planar side walls 25 while the interconnected louvers biasing mechanism 30 is toggled between the open and closed positions. In this manner, the body 20 may be maintained at a substantially stable position during articulation of the interconnected louvers 24. This provides and unpredictable and unexpected benefit and is advantageous in that it may ensure the register 10 does not slide or become undesirably repositioned when a user applies force to the lever 32 to open the louvers 24. The affixing mechanism 40 may apply outward pressure upon the side walls 25 to make certain that a magnetic connection is maintained with the metallic air duct.

Referring now to FIGS. 3 and 4, the magnetically affixing mechanism 40 may further include a plurality of rectilinear arms 42 statically affixed to the drive wheels 36 and preferably pivotal about the first fulcrum axis as the drum 34 rotates. Also, the mechanism 40 may include a plurality of driven wheels 44 rotatably engaged with the rectilinear arms 42 respectively. In this manner, the driven wheels 44 may be rotated about a second fulcrum axis registered parallel to the first fulcrum axis when the user reciprocates the lever 32, turning the drum 34 and respective drive wheels 36, and urging the arms 42 to turn the driven wheels 44 in sync therewith.

Additionally, a plurality of magnetic members 46 may be dynamically coupled to selected ones of the planar side walls 25, which is vital and advantageous in securing the register 10 to the inner walls 25 of the air duct. Each of the magnetic members 46 may have a medial end 47 seated inside the body 20 and continuously mated to the driven wheels 44. In addition, the magnetic members 46 may have rectilinear longitudinal lengths extending along a major longitudinal length of the planar side of the register 10 to ensure a stable and secure magnetic connection between the majority of the side wall 25 and the air duct. The magnetic members 46 spanning the distance of the side walls 25 may provide a stable and secure method of attaching the register 10 to the metal air duct, and such elements are not rendered obvious by one skilled in the art.

Again referencing FIGS. 3 and 4, each of the driven wheels 44 may additionally have a groove 50 formed therein, with the grooves 50 preferably having a varying depth defined along a longitudinal length thereof. In operation, the magnetic members 46 may be linearly reciprocated along respective second linear travel paths defined by the varying depth of the grooves 50 as the driven wheels 44 are rotated along clockwise and counter clockwise directions. As the driven wheels 44 rotate, the medial ends 47 of the magnetic members 46 may rise and fall with the depth of the grooves 50, creating an outward force against the magnetic members 46 and side walls 25 and assisting in maintaining the magnetic connection with the air duct as the user applies force to the lever 32.

Referring to FIGS. 1-4, the first and second linear travel paths being oriented parallel to each other. Thus, while the user applies force to the lever 32, the magnetic members 46 may be simultaneously forced in an identical and opposite linear direction concurrently by the affixing mechanism, which is vital in ensuring the register 10 remains securely connected to the air duct. Further, a reciprocating linear displacement of the lever 32 may cause a reciprocating pivoting displacement of the louvers 24 as well as a reciprocating linear displacement of the magnetic members 46 respectively.

In particular, the magnetic members 46 may be simultaneously urged outwardly and away from the planar side walls 25 when the lever 32 is linearly reciprocated along the first linear travel path. The combination of these elements provides the unpredictable and unexpected result of allowing the user to adjust the air flow through the louvers 24 while ensuring the register 10 remains statically situated, even without the use of traditional screw or bolt fasteners.

Again referring to FIGS. 1-4 in general, the present invention 10 may further include a method for removably affixing an air register 10 to an existing air duct. Such a method may include the chronological steps of first providing a body 20 preferably having an open panel 22 provided with a plurality of interconnected louvers 24 situated therealong. The body 20 further may include a plurality of planar side walls 25 extending orthogonally to the panel 22 and disposed inwardly from an outer perimeter of the panel 22 respectively. The body 20 may be produced in a variety of sizes to best fit within standard sized openings of common ductwork designs.

A second step of the method may include providing a mechanism 30 for articulating the interconnected louvers 24 between open and closed positions. Third, the method may entail providing a mechanism 40 for magnetically affixing the planar walls 25 to the existing air duct. Finally, a fourth step of the method may include automatically displacing the magnetically affixing mechanism 40 outwardly and away from the planar side walls 25 while toggling the interconnected louvers biasing mechanism 30 between the open and closed positions. In this manner, the body 20 may be maintained at a substantially stable position during articulation of the interconnected louvers 24.

The combination of the louver biasing mechanism 30 and the magnetic affixing mechanism 40 provides an unpredictable and unexpected result which is not rendered obvious by one skilled in the art. Such a design and method permits a user to employ an aesthetic and more safe, smooth surfaced register 10 to cover existing air ducts, and ensures that the register 10 remains secure and in place when opening and closing the louvers 24 to adjust air flow.

In an alternative embodiment, the register 10 may employ a set of gears to take the place of the drive wheels 36, rectilinear arms 42, and driven wheels 44. A variety of arrangements may be utilized to accomplish the same result of turning the driven wheels 44 to force the medial ends 47 of the magnetic members 46 outwardly to secure a magnetic connection with the air duct. One skilled in the art understands that a variety of methods may be employed, and the present invention should not be limited by the elements described hereinabove.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An air register for diffusing air away from an existing air duct, said air register comprising:

a body having an open panel provided with a plurality of interconnected louvers situated therealong, said body further having a plurality of planar side walls extending orthogonally to said panel;

means for articulating said interconnected louvers between open and closed positions; and means for magnetically affixing said planar walls to the existing air duct;

means for synchronizing the means for articulating said interconnected louvers and said means for magnetically affixing said planar walls;

wherein said magnetically affixing means is automatically displaced outwardly and away from said planar side walls while said interconnected louvers biasing means is toggled between said open and closed positions such that said body is maintained at a substantially stable position during articulation of said interconnected louvers;

wherein said magnetically affixing means comprises a plurality of magnetic members directly engaged with said planar side walls;

wherein said magnetic members are rectilinear and extend parallel to corresponding longitudinal lengths of said planar side walls respectively.

2. The air register of claim 1, wherein said interconnected louvers biasing means comprises:

a lever situated exterior of said panel and being reciprocated along a first linear travel path defined orthogonal to a longitudinal length of said body;

a drum directly coupled to said lever in such a manner that said drum is caused to rotate along clockwise and counter clockwise directions as said lever is linearly reciprocated along the first linear travel path;

a plurality of drive wheels mated to said drum such that said drive wheels are coaxially and synchronously rotated with said drum about a first fulcrum axis; and a rectilinear driven rod rotatably conjoined to said drive wheels respectively, said driven rod being caused to rotate in sync with said drive wheels and thereby articulate said interconnected louvers between said open and closed positions as said lever is linearly reciprocated along said first linear travel path.

3. The air register of claim 2, wherein said magnetically affixing means comprises:

a plurality of rectilinear arms statically affixed to said drive wheels and being pivotal about said first fulcrum axis as said drum rotates;

a plurality of driven wheels rotatably engaged with said rectilinear arms respectively such that said driven wheels are rotated about a second fulcrum axis registered parallel to said first fulcrum axis, each of said driven wheel having a groove formed therein, said grooves having a varying depth defined along a longitudinal length thereof; and said magnetic members being dynamically coupled to selected ones of said planar side walls, each of said magnetic members having a medial end seated inside said body and continuously mated to said driven wheels;

wherein said magnetic members are linearly reciprocated along respective second linear travel paths defined by said varying depth of said grooves as said driven wheels are rotated along clockwise and counter clockwise directions.

4. The air register of claim 3, wherein said drum comprises: an oscillating channel formed along an outer surface thereof such that said lever causes said drum to rotate as said lever is linearly reciprocated along the first linear travel path.

5. The air register of claim 3, wherein said first and second linear travel paths are oriented parallel to each other.

6. The air register of claim 3, wherein a reciprocating linear displacement of said lever causes a reciprocating pivoting displacement of said louvers as well as a reciprocating linear displacement of said magnetic members respectively.

7. The air register of claim 3, wherein said magnetic members are simultaneously urged outwardly and away from said planar side walls when said lever is linearly reciprocated along the first linear travel path.

8. The air register of claim 3, wherein said magnetic members have rectilinear longitudinal lengths extending along a major longitudinal length of said planar side.

9. An air register for diffusing air away from an existing air duct, said air register comprising:

a body having an open panel provided with a plurality of interconnected louvers situated therealong, said body further having a plurality of planar side walls extending orthogonally to said panel and disposed inwardly from an outer perimeter of said panel respectively;

means for articulating said interconnected louvers between open and closed positions; and means for magnetically affixing said planar walls to the existing air duct;

means for synchronizing the means for articulating said interconnected louvers and said means for magnetically affixing said planar walls;

wherein said magnetically affixing means is automatically displaced outwardly and away from said planar side walls while said interconnected louvers biasing means is toggled between said open and closed positions such that said body is maintained at a substantially stable position during articulation of said interconnected louvers;

wherein said magnetically affixing means comprises a plurality of magnetic members directly engaged with said planar side walls;

wherein said magnetic members are rectilinear and extend parallel to corresponding longitudinal lengths of said planar side walls respectively.

10. The air register of claim 9, wherein said interconnected louvers biasing means comprises:

a lever situated exterior of said panel and being reciprocated along a first linear travel path defined orthogonal to a longitudinal length of said body;

a drum directly coupled to said lever in such a manner that said drum is caused to rotate along clockwise and counter clockwise directions as said lever is linearly reciprocated along the first linear travel path;

a plurality of drive wheels mated to said drum such that said drive wheels are coaxially and synchronously rotated with said drum about a first fulcrum axis; and a rectilinear driven rod rotatably conjoined to said drive wheels respectively, said driven rod being caused to rotate in sync with said drive wheels and thereby articulate said interconnected louvers between said open and closed positions as said lever is linearly reciprocated along said first linear travel path.

11. The air register of claim 10, wherein said magnetically affixing means comprises:

a plurality of rectilinear arms statically affixed to said drive wheels and being pivotal about said first fulcrum axis as said drum rotates;

a plurality of driven wheels rotatably engaged with said rectilinear arms respectively such that said driven wheels are rotated about a second fulcrum axis registered parallel to said first fulcrum axis, each of said driven wheel having a groove formed therein, said grooves having a varying depth defined along a longitudinal length thereof; and said magnetic members being dynamically coupled to selected ones of said planar side walls, each of said magnetic members having a medial end seated inside said body and continuously mated to said driven wheels;

wherein said magnetic members are linearly reciprocated along respective second linear travel paths defined by said varying depth of said grooves as said driven wheels are rotated along clockwise and counter clockwise directions.

12. The air register of claim 11, wherein said drum comprises: an oscillating channel formed along an outer surface thereof such that said lever causes said drum to rotate as said lever is linearly reciprocated along the first linear travel path.

13. The air register of claim 12, wherein said first and second linear travel paths are oriented parallel to each other.

14. The air register of claim 12, wherein a reciprocating linear displacement of said lever causes a reciprocating pivoting displacement of said louvers as well as a reciprocating linear displacement of said magnetic members respectively.

15. The air register of claim 12, wherein said magnetic members are simultaneously urged outwardly and away from said planar side walls when said lever is linearly reciprocated along the first linear travel path.

16. The air register of claim 12, wherein said magnetic members have rectilinear longitudinal lengths extending along a major longitudinal length of said planar side.

* * * * *